United States Patent [19]

Lemelson

[11] 4,179,832

[45] Dec. 25, 1979

[54] INFLATABLE DISPLAYS

[76] Inventor: Jerome H. Lemelson, 85 Rector, St. Metuchen, N.J. 08840

[21] Appl. No.: 755,144

[22] Filed: Dec. 29, 1976

[51] Int. Cl.[2] ..... G09F 13/00

[52] U.S. Cl. ..... 40/540; 40/550; 46/88; 362/811

[58] Field of Search ..... 40/126 B, 106.52, 125 N, 40/130 D, 130 R, 125 L, 212–214, 130 L, 540, 550; 46/87, 88, 90; 240/10 D, 10 T; 362/806, 811

[56] References Cited

U.S. PATENT DOCUMENTS

| | | | |
|---|---|---|---|
| 2,557,383 | 6/1951 | Kerwer | 40/130 D X |
| 2,816,378 | 12/1957 | Levinson | 40/126 B X |
| 3,066,439 | 12/1962 | Lemelson | 46/88 |
| 3,234,685 | 2/1966 | Harrowe | 46/88 |
| 3,723,723 | 3/1973 | Lerner | 240/10 T |

*Primary Examiner*—John F. Pitrelli

[57] ABSTRACT

Structures are provided in inflatable displays which include arrays of electric lamps which are operable for creating a variety of lighting effects including both stationary and flashing or simulated moving light effects. In one form, the display is formed of flexible transparent plastic and extends a substantial distance above the ground, when inflated, to provide support for one or more strings of electric lamps. The lamps of each string or row thereof are intermittently energized in a manner to provide the illusion of upward or downward movement of one or more light sources to attract attention. The inflated portion of the display, because of its transparency, appears to be substantially invisible at night time. In another form, the inflated portion of the display is bulbous in configuration when internally inflated. In yet another form, the inflated portion of the display comprises one or more upwardly extending elongated or tapered portions, each supporting one or more strings of electric lamps thereon. The lamps may be supported on the exterior surface of the inflated wall or interior thereof so as to be protected from the elements. The string of lamps is retained in position by securing the wire or cable to which the lamps are attached to the inside or outside surface of the inflatable wall.

15 Claims, 10 Drawing Figures

INFLATABLE DISPLAYS

SUMMARY OF THE INVENTION

This invention relates to improvements in displays, particularly constructed of inflatable plastic and containing electric lamps attached to the upwardly extending wall portions of the displays for creating various dynamic lighting effects. By providing the supporting means for the electric lamps fabricated of a relatively thin plastic sheet material which is maintained erect above the ground by inflating an enclosure made of such material, the inflated wall portion or portions thereof may be rendered sufficiently self supporting to support a plurality of electric lamps, sockets and wires therefore secured to either the outside or inside surface of the inflated wall portion. Where the lamps and wire cable therefore are secured to the inside surface of the inflated portion of the display, a removable portion of the wall of the display is provided which is easily replaced in a sealed condition across an opening in the display wall, to permit access to the interior of the inflatable wall. Various configurations are provided herein for the inflated body portion or portions of the display.

Accordingly, it is a primary object of this invention to provide new and improved structures in inflatable displays which are light in weight, relatively low in cost and capable of easy erection and deflation to collapse and permit the display to be easily transported or packaged.

Another object is to provide a low cost structure in a display which will support one or more strings of electric lamps in an upwardly extending attitude when the display is inflated.

Another object is to provide relatively large, lightweight supporting means for one or more strings of electric lamps employed to provide an attention getting stationary lighting effect or to generate dynamic lighting effects.

Another object is to provide improvements in light weight illuminated displays which are easily transported and easily erected at the site of their use.

Another object is to provide large, light weight illuminated displays which may be operated to provide a variety of lighting effects at low cost and without the need to expend labor in the erection of structures for supporting the displays;

Another object is to provide large, light weight electrically operable displays which may be used both indoors and out of doors to provide effects simulating fireworks by flashing illumination of lamps supported by the displays;

Another object is to provide large light weight illuminated displays comprising a plurality of strings of electric lamps which appear to be supported in space.

Another object is to provide displays in the form of inflatable enclosures which may be easily erected and collapsed and which may contain and protect lamps and other display means within the enclosures.

Another object is to provide a display including a water fountain generating means which may be rapidly erected at any location and which includes inflatable enclosure means for preventing water from the fountain from splashing or spilling onto the ground or a floor.

Another object is to provide a water and illumination display device which may be rapidly transported and erected at any location and easily operated thereafter to provide an eye catching phenomenon.

With the above and such other objects in view as may hereinafter more fully appear, the invention consists of the novel constructions, combinations and arrangements of parts as will be more fully described and illustrated in the accompanying drawings but is to be understood that changes, variations and modifications may be resorted to which fall within the scope of the invention as claimed without departing from the spirit and scope of the invention.

Figures 1, 1A, 1B, 2, 3, 4, 5, 6, 7, 8:
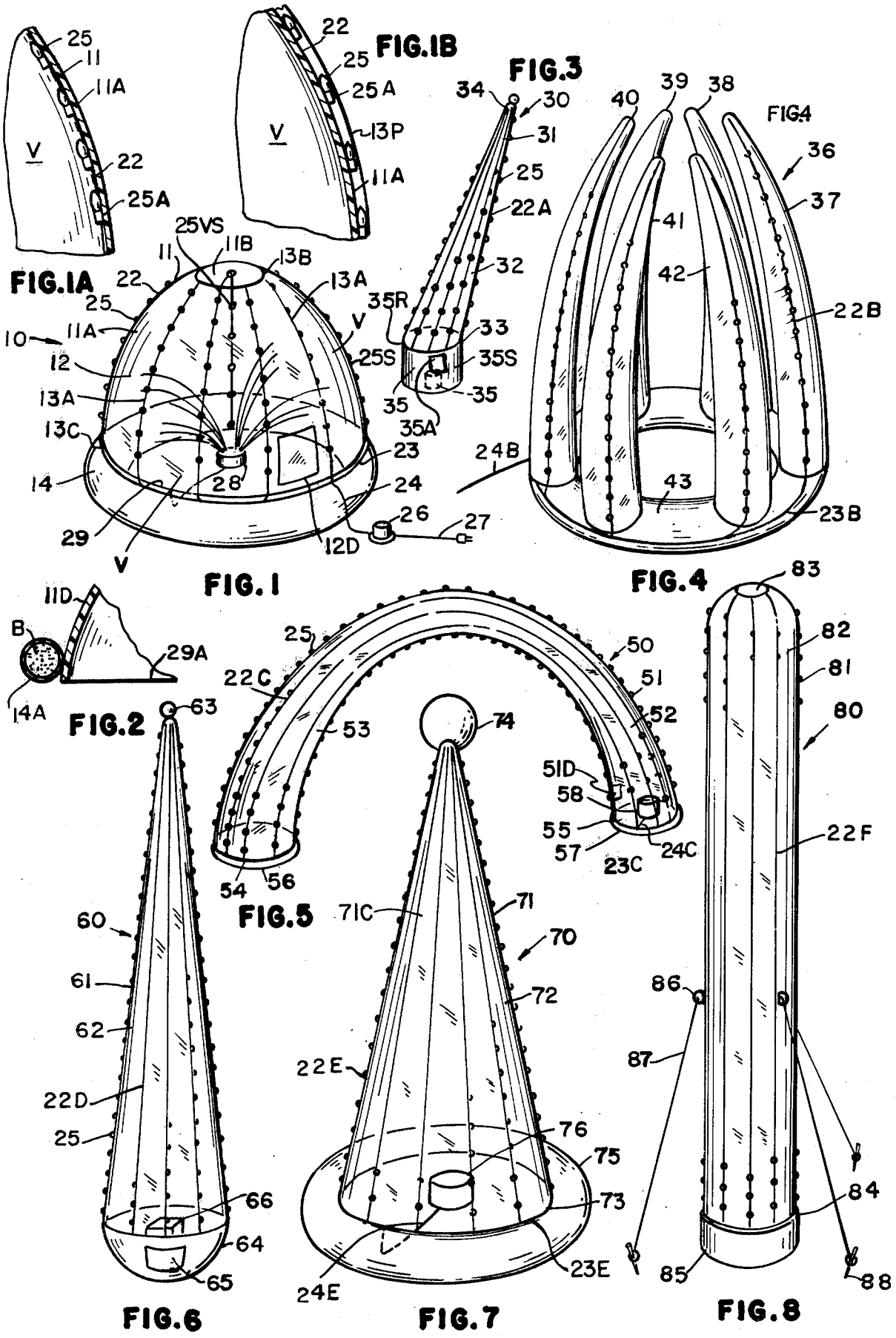
FIG. 1 is an isometric view of a first form of inflated display having an upwardly extending wall portion which inflates to a semi-spherical or paraboloid shape and which is secured at its lower extremeties to a base ring which may also be inflated.
FIG. 1A is a cross sectional view of a fragment of a portion of a modified form of the inflated display of FIG. 1.
FIG. 1B is a cross sectional view of a portion of a display of the type illustrated in FIG. 1.
FIG. 2 is a cross sectional view of a portion of a modified form of the display of FIG. 1.
FIG. 3 is an isometric view of an elongated inflated display having an upper flexible wall portion of conical shape when inflated and supported by a weighted cylindrical base portion.
FIG. 4 is an isometric view of an inflated and lighted display containing a plurality of upwardly extending elongated inflated portions secured to an inflated base ring and each containing one or more strings of electric lamps which may be simultaneously energized for steady illumination of the display and/or intermittent illumination thereof.
FIG. 5 is an isometric view of an inverted U shaped inflated display.
FIG. 6 is an isometric view of a modified form of the display shown in FIG. 3 and having a rounded weighted bottom to permit the display to sway or rock back and forth.
FIG. 7 is an isometric view of a modified form of the display shown in FIG. 1 wherein the upwardly extending portion thereof is conical shaped and contains a large display element at its upper end.
FIG. 8 is an isometric view of an inflated display having an inflated cylindrical side wall extending a substantial distance above the ground and provided with means for supporting the inflated side wall and retaining it in location on the ground.

There is shown in FIG. 1 an inflated display 10 defined by a flexible wall enclosure 11 which inflates to substantially a semi-spherical or paraboloid shape, the side wall 11A of which is composed of a plurality of panels 12 of flexible sheet material such as plasticized polyvinyl chloride, flexible polyeurethane, rubber coated fabric or laminations of nylon and other suitable flexible plastics. The material composing panels 12 is preferably, although not necessarily, transparent depending on the optical display effects which are desired to be attained. The panels 12 are preferably welded together along their longitudinal edges defining weld lines 13A extending to a circular section 11B at the top of the enclosure which is welded to the upper ends of the panels by means of a circular weld line 13B. At their lower ends the panels 12 are welded to the upper surface of a base ring 14 which may be inflatable or made of a rigid plastic molding or extrusion, notation 13C defining the circular weld line between the lower ends of the panels 12 and the upper surface of 14.

The bottom edges of the panels 12 may also be welded to a circular section of flexible plastic sheet, denoted 29, to form an enclosed volume V therewith or with ring 14, which enclosed volume may be air pressurized to provide a semi-spherical or otherwise shaped panel wall 11.

Secured to the side wall 11A of the assembly 10 are a plurality of electric lights 25, preferably arrayed in a plurality of strings 25S of lights of the same or different colors, with each string comprising separate lights or lamps per se connected thereto or removably assembled in sockets 25A which are electrically connected to one or more wire pairs in separate plastic sheavings 22 which extend upwardly along and are attached to the flexible side wall 11A. The sheavings 22 thus define electrical cables containing respective strings of electric lamps 25 which may be continuously or intermittently energized to provide flashing light effects. In one form, the cables 25 contain sufficient wires to separately energize each of the lamps 25 connected to the cable so that, depending on the manner in which the wires are energized and de-energized, lighting effects may be derived including the effects of one or more light sources moving in an upwardly direction along the inflated wall 11A and/or in a downwardly direction therealong depending on the manner in which the lamps are flashed on and off.

In FIG. 1, the wires or cables 22 each extend along a respective weld line 13A between the longitudinal edges of the panels 12 although they may also extend upwardly along and be attached to each or selected of the panels 12 intermediate of the longitudinal edges thereof. The wires or cables 22 may be secured to the inside surface of the flexible side wall 11A, as illustrated in FIG. 1A or to the outside surface thereof as illustrated in FIG. 1B. Both the flexible wires 22 and the lamps 25 secured at spaced apart locations therealong may be retained in elongated pockets 13P of flexible plastic which is bonded or welded along the panels 12 between the longitudinal edges thereof or is formed of the material of said panels protruding outwardly or inwardly from the side wall beyond the weld lines 13A. Each of the wire conducting pairs or multiple wired cables 22 extends to a header cable 23 supported by the outer surface of the ring 14 either outwardly from or inwardly of the volume V and extending completely around the ring 14 to a takeoff extension 24 which extends through a switch 26 to an extension line 27 which is connected to a source of electrical energy remote from the display 10. The switch 26 may also comprise a motor operated rotary multiple pole switch operable to sequentially switch the lamps of each string 25S on and off in a manner to provide the effect that the lights thereof are moving in an upward and/or downward direction.

It is also noted that the electrical energy source may comprise a battery which is supported immediately adjacent to or attached to the ring 14 either externally or internally with respect to the volume V.

Also illustrated in FIG. 1 is a device 28 supported within the volume V against the upper surface of the bottom wall 29 of the enclosure. Device 28 may comprise one of a number of devices including a pump and spray head assembly for receiving water filling part of the volume V and spraying it upwardly within the volume to provide a visual water spray display which may be illuminated by lamps 25 or lamps within the unit 28. Unit 28 may also comprise an electrically operated lighting device for providing dynamic lighting effects such as projected colored light which is directed against the wall 11A and is made to move by motorized means within device 28 or to flash on and off by suitable switching means forming part of device 28.

FIG. 1A shows a portion of the enclosure 11 of FIG. 1 in cross section with the lamps 25 each connected to a socket 25A which is electrically connected to and supported by the cable 22 which is fastened by means of tape or other means to the inside surface of the side wall 11A and extends upwardly therealong described.

In FIG. 1B the string of lamps 25 and cable 22 is shown secured to the outside surface of the side wall 11A by means of suitable adhesive or sealed tape or a pocket denoted 13P sealed to the outside surface of wall 11A.

Notation 12D refers to a door provided across an opening in one of the panels 11A and removeably sealed thereto to provide access to the interior of the enclosure for maintenance purposes.

Also shown in FIG. 1 is a string 25VS of electric lamps which is secured to the upper end of the enclosure and hangs freely down inside the volume V when the structure is inflated for illuminating the inside of the enclosure. This string of lamps may replace or supplement the lamps secured to the inflated wall 11.

FIG. 2 illustrates a modified form of the structure of FIG. 1 wherein the side wall 11D of the inflated enclosure is sealed along its lower peripheral edge to a disc shaped sheet of flexible or rigid plastic 29A forming the bottom wall of the enclosure and a ring 14A of suitable flexible or rigid plastic containing a ballast B is secured to the side wall or the bottom wall 29A for retaining the enclosure 11 in place.

Other means may be provided for securing the enclosure 11 or any of the displays to be described to the ground or floor on which it is erected by inflation include the use of a plurality of separate units of ballast or weights secured around the periphery of the base of the display or disposed thereagainst without attachment thereto; the use of ballast such as water or sand within the volume V or weights against the upper surface of the bottom wall 29 or the extension of the bottom wall 29 or 29A as a circular flap or tabs beyond the periphery of the bottom of the side wall of the enclosure 11 to which flap or tabs stakes or weights may be attached. Water may also be disposed or circulated in the ring or torroid 14 for ballast. Electric lights may also be supported within said ring or torroid to be constantly energized or flashed on and off during operation of the display.

In addition to the paraboloidal or spheroidal shape shown in FIG. 1, the inflatable enclosure may be made in a variety of different shapes including representations of a globe which as one representing the earth or moon with transparent colored or opaqure colored printed matter on the ouside surface thereof, figures, buildings and other structures as illustrated in the other drawings.

In FIG. 3 is shown a display 30 composed of a conically shaped inflated upper portion 31 formed of a series of tapered panels 32 of flexible plastic as described which are longitudinally edge sealed together. The lower rim 33 of the conical wall 31 are sealed to a cylindrical container 35 which serves a number of functions. In addition to supporting the inflated portion 31 of the display 30 and serving as a base therefore, container 35 also contains a battery and control or switching means denoted 35A for a plurality of electric lamps 25 which extend along one or more cables 22A secured to and extending vertically along the side wall 31 from the bottom to the top end of the enclosure. The lamps 25 may be attached and supported by the enclosure by the means illustrated in FIGS. 1A or 1B. The cylindrical base 35 has an upper rim 35R to which the lower rim of the inflated enclosure 31 is sealed and contains either a transparent upper wall or is open at the top. Wires 22A extend downwardly along the side wall 32 to a cable (not shown) located within the enclosure and base 35 which connects, through a suitable switch 35S accessible to the outside of 35 and extending to a battery 35B or other source of electrical energy located within housing 35. An extension cord may also extend from the header connected to wires 22A to an external source of electrical energy. Door 35A in side wall 35 permits access to the interior thereof for maintenance purposes.

FIG. 4 illustrates another form of the invention comprising a display 36 which includes a base ring 43 of rigid or flexible plastic and to which is secured a plurality of upwardly extending conically shaped inflated enclosures denoted 37, 38, 39, 40, 41 and 42. The enclosures 37–42 are either separately inflatable and fabricated separate from each other or may be inflated when the base ring 43 is inflated by virtue of having their base portions welded or heat sealed to the wall of the ring 43 and openings in the wall connecting the volume interior of 43 with the interior volumes of the conical extensions 37–42.

Each of the inflated conical members 37–42 has one or more strings 22B of electric lamps secured to the outside surfaces thereof and extending upwardly therealong. The wires 22B connect to a header wire 23B which extends around the ring 43 and which is connected to an extension line 24B which itself is connected to a source of electrical energy through a switching device for controlling the flashing operation of the lamps 25.

FIG. 5 illustrates another form of the invention comprising an inflated display 50 which is formed with a side wall 51 formed of a plurality of panels 52 configured to provide the inverted U-shaped enclosure illustrated. Extending along the upper and lower surfaces of the U-shaped wall 51 are a plurality of strings of cable 22C and respective lamps 25 supported thereby as described. Connected to the lower ends 54 and 55 of the enclosure 51 are respective discs 56 and 57 of suitable rigid material which also serve as ballast for retaining the inflated enclosure 51 in the upright condition illustrated. The wires of cable 22C are secured to the outside or inside surfaces of the flexible panels 52, as hereinbefore described, and are connected to a battery 58 supported against the upper surface of the disc shaped member 57 at the end 55 of the display 50 by means of a header cable 24C containing separate wires or cables extending to each of the wires 22C. Battery 58 is preferably acceptable for replacement or recharging through a trap door denoted 51D which is sealed to the disc 57.

FIG. 6 illustrates a modified form of the invention which is somewhat like that illustrated in FIG. 3 but which includes an unstable rounded base 64 on which an inflatable conically shaped enclosure 61 may be made to sway or rock. The display 60 is composed of a tapered or conical side wall 61 made of a number of panels 62 of suitable flexible material as described and each of which is heat sealed or welded along its longitudinal edges to adjacent panels forming the illustrated cone shaped enclosure. Extending upwardly along the side wall 61 are a plurality of strings of lamps 25 as described which are connected through a suitable cable or header (not shown) to a battery 66 located within the semi-spherical base 64. The battery 66, switching and control means for the lamps, preferably provide ballast for retaining the semi-spherical base 64 in an upright condition wherein the semi-spherical surface thereof may permit it to sway to some degree in the wind to provide a dynamic lighting effect when the lamps 25 are energized wherein the steadily energized or flashing lamps move as the conical wall 61 sways. Notation 63 refers to a lamp located at the top end of the conical side wall 61 and connected through one of the wires illustrated to the battery 66. Notation 65 refers to a door which is sealingly engaged across an opening in the wall of the semi-spherical base 64 for providing access to the interior of the enclosure when deflated.

FIG. 7 shows a display having a conically shaped side wall 71 defining a conical enclosure and made of a plurality of tapered panels 72 which are heat sealed or welded to each other along their longitudinal edges and are welded along their base portions to an inflated ring 75. Cables 22E defining strings of lamps 25 extend upwardly along the conical side wall 71 and are secured to the inside and/or outside surfaces thereof. Each of the cables 22E connects to a header 23E which extends to a wire or cable 24E extending to a housing 76 containing a battery and/or sequential switch such as a rotary motorized switch for flashing the lamps on and off in predetermined sequences to provide the described effects of light movement either upwardly and/or downwarly along the side wall of the enclosure and/or within the enclosure by the one or more strings of lamps which may hang therein in the manner shown in FIG. 1.

Notation 74 refers to an inflated or rigid spherically shaped enclosure at the top of the enclosure 71C which top mounted enclosure may contain one or more electric lamps which may be steadily illuminated or made to flash on and off therein. The ball shaped enclosure 74 may also have a variety of other shapes and may also contain one or more motorized devices or display units attached thereto such as means for rotating a part of the display on the outside and/or inside of the enclosures 71 or 74.

In FIG. 8 is shown a display 80 composed of a cylindrically shaped inflated side wall 81 formed of a plurality of rectangular plastic panels 82 which are longitudinally sealed together and either sealed together at their ends or to other material to form a tube shaped display as shown. A circular patch 83 of flexible plastic is shown sealed to the upper end of the tube shaped wall 81 while the lower end of the enclosure is shown secured to a ballast device in the form of a plastic or metal can or cylinder 85 which may contain a battery and/or switching device as described. Tabs or eyelets 86 secured to or extending from the material of the side wall are provided to which wires or strings 87 may be attached to retain the display upright when inflated. The lower ends of the wires 87 are shown secured to stakes 88 held in the ground.

We claim:

1. A display comprising is combination:

an elongated inflatable enclosure, an inflatable base secured to said inflatable enclosure for supporting said inflatable enclosure with the longitudinal axis thereof extending upright from a supporting surface, said inflatable enclosure having a flexible side wall adapted to become erect and to extend upwardly from said base when said enclosure and said base are inflated and said base is disposed on said supporting surface, electrical conducting means comprising at least one elongated flexible cable containing at least one wire pair for conducting electrical energy along the length of said cable, means for flexibly supporting said electrical cable against said flexible side wall of said enclosure to permit the cable to extend longitudinally along most of the length of said inflatable enclosure, a plurality of electric lamps electrically connected to said cable at different locations along the length of said cable and supported at different locations longitudinally along said flexible side wall of said inflatable enclosure, and means for supplying electrical energy to the conducting elements of said cable for energizing said electric lamps connected thereto to provide a display formed of said plurality of electric lamps energized and emitting light at said different locations upwardly along said flexible side wall of said inflatable enclosure.

2. A display in accordance with claim 1 wherein said flexible side wall of said enclosure is tapered in shape to provide a conical support for said electric lamps supported by and extending upwardly from said support.

3. A display in accordance with claim 1 wherein said flexible side wall of said enclosure is made of a transparent flexible plastic material and is shaped to provide illusion, when inflated, that said electric lamps, when illuminated, are freely suspended in space.

4. A display in accordance with claim 1 wherein that portion of said flexible side wall supporting said electric lamps is made of a light transmitting material, said electric lamps being supported within said light transmitting material.

5. A display in accordance with claim 1 having a plurality of said cables supported by said flexible side wall of said enclosure and a plurality of electric lamps attached directly to respective of said cables and supported thereby to define a plurality of rows of electric lights extending along most of the length of said elongated inflatable enclosure.

6. A display in accordance with claim 1 wherein said inflatable base is circular in shape when inflated and said flexible side wall of said display is substantially conical in shape when inflated.

7. A display in accordance with claim 1 including means for intermittently energizing said lamps to provide a dynamic display lighting effect for at least part of the distance said display extends above the ground.

8. A display in accordance with claim 1 including means for intermittently energizing said lamps in a manner to provide the illusion of a moving light effect to a person viewing said display from the exterior thereof.

9. A display in accordance with claim 8 wherein said lamps are intermittently energized in such a manner as to provide the illusion of movement of a light source in an upward direction.

10. A display in accordance with claim 9 including a plurality of cables secured to and extending upwardly along said flexible side wall of said display, a plurality of electric lamps secured to each of said cables and means for applying electrical energy simultaneously to each of said cables.

11. A display in accordance with claim 8 in which said lamps are intermittently energized in such a manner as to provide the illusion of movement of the light source in a downward direction.

12. A display in accordance with claim 1 wherein said cable and said lamps are supported by said flexible side wall of said enclosure by a retaining means and means for sealing said retaining means to said flexible side wall of said enclosure.

13. A display in accordance with claim 1 wherein said flexible side wall is shaped and assembled to said inflatable support means to provide, when inflated, an exterior surface which is substantially dome shaped in configuration.

14. A display comprising in combination:

support means for a plurality of illuminated displays including a base and a plurality of elongated inflatable enclosures secured to said base, said inflatable enclosures having flexible side walls adapted to become erect and extend upwardly from said base when said enclosures are inflated, electrical conducting means including a plurality of elongated flexible cables each containing at least one wire pair for conducting electrical energy along the length thereof, means for flexibly supporting at least one of said electrical cables against the flexible side wall of a respective of said inflatable enclosures to permit the cable to extend upwardly therealong from the lower portion of the enclosure, a plurality of electric lamps electrically connected to each of said cables along the lengths of the cables and supported thereby at different locations upwardly along said flexible side walls of said enclosures, and means for supplying electrical energy to the conducting elements of said cables for energizing said electric lamps to provide a display formed of said plurality of electric lamps energized and emitting light at said different locations upwardly along said plurality of said elongated inflatable enclosures.

15. A display in accordance with claim 14 wherein at least portions of said inflatable enclosures supporting said electric lamps are made of light transmitting material and each of said plurality of flexible cable and the lamps attached thereto are supported within a respective elongated inflatable enclosure against that portion of the flexible side wall thereof which is made of said light transmitting material so that the illumination of said lamps may be viewed from the exterior of the inflated enclosure.

* * * * *